US005277252A

United States Patent [19]

Boe

[11] Patent Number: 5,277,252

[45] Date of Patent: Jan. 11, 1994

[54] SAMPLING TOOL FOR OBTAINING SAMPLES OF FLUIDS PRESENT IN A WELL

[75] Inventor: Einar Boe, Notodden, Norway

[73] Assignee: Norsk Hydro a.s., Oslo, Norway

[21] Appl. No.: 861,875

[22] PCT Filed: Dec. 14, 1990

[86] PCT No.: PCT/NO90/00186

§ 371 Date: Jun. 19, 1992

§ 102(e) Date: Jun. 19, 1992

[87] PCT Pub. No.: WO91/09207

PCT Pub. Date: Jun. 27, 1991

[30] Foreign Application Priority Data

Dec. 20, 1989 [NO] Norway ..... 895139

[51] Int. Cl.[5] ..... E21B 49/08

[52] U.S. Cl. ..... 166/162

[58] Field of Search ..... 166/162, 163, 164, 165, 166/166, 167, 168, 169, 264, 250

[56] References Cited

U.S. PATENT DOCUMENTS

| | | | |
|---|---|---|---|
| 2,623,594 | 12/1952 | Sewell | 166/164 |
| 2,632,512 | 3/1953 | Chaney et al. | 166/164 |
| 2,645,289 | 7/1953 | Leas . | |
| 2,855,050 | 10/1958 | Smith | 166/168 |
| 2,893,690 | 7/1959 | Chambers | 166/164 |
| 3,022,826 | 2/1962 | Kisling, III | 166/164 |
| 3,033,286 | 5/1962 | Fast et al. . | |
| 4,421,166 | 12/1983 | Cain | 166/164 |
| 4,846,279 | 7/1989 | Bruce | 166/162 |
| 4,846,364 | 7/1989 | Boe . | |

*Primary Examiner*—Ramon S. Britts
*Assistant Examiner*—Frank S. Tsay
*Attorney, Agent, or Firm*—Wenderoth, Lind & Ponack

[57] ABSTRACT

A sampling tool for immersion into a well for collection of samples of oil, gas or water during drilling for production includes a tubular, hollow and preferably cylindrical member with two chambers separated by a compressible pipe. An outer pipe is formed as a cylindrical member to withstand a reservoir pressure. Inside the outer pipe is positioned a unit forming a gas tight storage chamber for the gas-/liquid samples and a chamber for a counter pressure medium. The pipe is pressed against the inside of a U-profile. During sampling, the volume of the storage chamber will increase and the volume of the other chamber will be reduced corresponding to the increase of the storage chamber. Total separation of the gas-/liquid sample from the counter pressure medium is obtained by applying a diffusion tight flexible pipe, and the gas-/light sample analyzed will thus be representative of the reservoir gas-/liquid sampled.

17 Claims, 2 Drawing Sheets 7
11
8
6
15
2b,2c
12
9
2
1
2a
5
14
13
10
2
14
10
9
2
9
10
12
6
2
9
10
5

SAMPLING TOOL FOR OBTAINING SAMPLES OF FLUIDS PRESENT IN A WELL

BACKGROUND OF THE INVENTION

The invention relates to sampling tool to be immersed into a well for collection of samples during drilling for/production of oil, gas or water, and including a tubular, hollow and preferably cylindrical body.

During a drilling operation and during production of hydrocarbons it is necessary to collect samples of the gas/liquid present in a hydrocarbon reservoir. This is achieved by immersing into the well a sampling tool for collecting samples at different depths. The sampler is then hoisted to the surface where the sample is transferred from the sampling tool to a suitable transportation bottle for further laboratory analysis of the chemical and physical characteristics of the sample.

A sampling tool for obtaining gas-/liquid samples basically includes a tubular cylindrical body comprising a storage chamber for conversing the gas-/liquid samples taken and valves for opening and closing the inlets to the storage chamber. In addition to the storage chamber, the equipment also includes various electronic equipment for measuring pressure, temperature, etc. The sampling tool is connected to the surface by a lifting wire having an insulated copper core. The sampling tool may also be mechanically controlled from the surface by using a mechanical steering rod inside the pipe. The steering rod is used to open and close the valves for the supply of gas-/liquid samples.

Sampling tools with a storage chamber usually include a floating piston for separating the gas-/liquid sample physically from a counter pressure medium. The counter pressure medium is used to control the flow from the reservoir into the storage chamber. During sampling, the gas-/liquid samples flow into the chamber on one side of the piston and the counter pressure medium is pressed out of the cylinder into an atmospheric chamber. There are O-ring seals between the piston and the cylinder wall. These O-rings are exposed to wear caused by a combination of rubbing against the cylinder wall and contact with usually very aggressive hydrocarbon fluids. Besides, the seals allow diffusion from one side of the piston to the other. Therefore, the disadvantage of such tool is that hydrocarbons leak or diffuse from one side of the piston into the counter pressure medium on the other side of the piston. When fractions of the gas-/liquid sample diffuse or leak from the sample due to worn-out piston seals, the gas-/liquid sample will not be representative and the test has to be repeated. This increases the costs for obtaining oil- and gas samples considerably, especially offshore because of very expensive rig time.

Another method for sampling is to use tools with a time controlling system for opening the valves and a subsequent filling of the storage chamber. This method is not convenient, because problems or delays often arise when the equipment is brought down into the well. Both the time controlling system and the use of a steering rod for opening the valves depend on relatively complex mechanical systems. The mechanical systems as described are exposed to wear and defects which will lead to increasing expenses, both in the form of broken equipment and need for repeating the tests.

SUMMARY OF THE INVENTION

The main object of the present invention is to develop a tool for obtaining representative gas-/liquid samples without risk of leakage from a sample storage chamber to counter pressure chamber. It is further an object of the invention to provide such a tool which is reliable and easy to handle and which will ensure quick and reliable sampling.

These and other objects of the invention are obtained with the apparatus described below, and the invention is further defined and characterized in the accompanying claims.

Since the problem with known equipment is both related to the piston rings and a complicated mechanical construction, it is essential to replace the O-rings with another form of seal or membrane and generally to simplify the construction of the sampling tool. Because O-rings or seals are needed in all piston/cylinder constructions, it is necessary to find an arrangement without pistons which also could separate the counter pressure medium from the gas-/liquid sample. After the inventor had considered different solutions he tried to use a membrane formed as a pipe for separating the sample from the counter pressure medium. The arrangement was tested, and certain types of membranes provided a solid and diffusion tight seal. If a flexible membrane made of a diffusion tight material was used, the danger of leakage from the storage chamber into the chamber containing the counter pressure medium was eliminated.

The sampling tool according to the invention includes a cylindrical body with two channels and valves basically positioned at each of opposite ends of the said body. One channel leads to a chamber for a counter pressure medium and the other channel leads to a gas-/liquid storage chamber. The chamber for the counter pressure medium is limited by an inner wall of an outer pipe and an outer wall of a pipe inside the outer pipe. The internal pipe is made of flexible material, preferably lead.

The storage chamber is limited by the inner wall of the lead pipe and by two supporting wedges fixed to a U-profile or U-shaped member. The U-profile and a unit of the lead pipe and the wedges form a gas-tight chamber inside the lead pipe.

Before the apparatus is immersed into a well for sampling, the chamber between the outer pipe and the inner pipe is filled with a counter pressure medium, for instance glycol, and the flexible pipe is folded by the pressure of such medium around the U-profile and the wedges. Air and other possible polluting gases/fluids are thus pressed out of the sampling chamber. The sampling tool is then immersed into the well to a given sampling depth. The valve for the gas-/liquid supply channel is opened simultaneously as the valve for discharging the counter pressure medium is opened either to a chamber with atmospheric pressure or directly to the reservoir formation surrounding the sampling unit. The gas-/liquid sample will fill the storage chamber inside the lead pipe. This pipe is now gradually forced back to its original cylindrical shape as the chamber is filled by the gas-/liquid sample. Simultaneously, the volume of the counter pressure chamber is reduced and the counter pressure medium is gradually forced into the chamber at atmospheric pressure. The sampling velocity is regulated by regulating the flow of counter pressure medium through a nozzle.

The chamber at atmospheric pressure has a volume less than the volume of the storage chamber. That means that at maximum filling of the storage chamber there will be some liquid remaining in the counter pressure chamber. The object of the volume difference of the two chambers is to prevent the lead pipe from having metal to metal contact and being punctured. When sampling is finished, the sampling unit is raised to the surface by a lifting wire. The gas-/liquid samples are then transferred at a constant pressure and volume to suitable transport and storage bottles for further transport and analysis.

BRIEF DESCRIPTION OF THE DRAWINGS

Other characteristics of the invention are described in detail below with reference to the accompanying drawings in which.

DETAILED DESCRIPTION OF THE INVENTION

Figures 1, 2A, 2B, 2C:
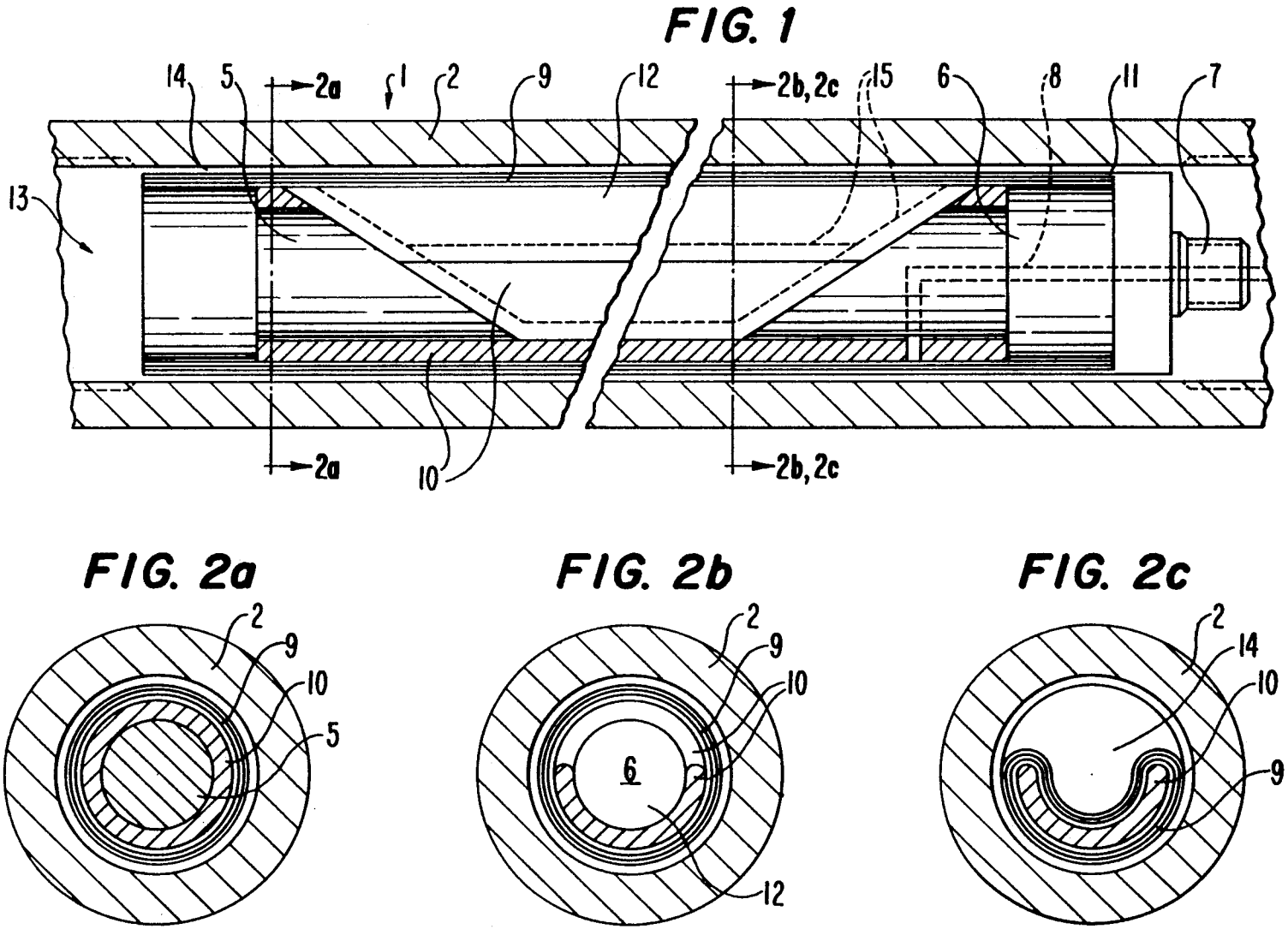
FIG. 1 is a longitudinal section illustrating a sampling tool according to the invention, with end wedges thereof shown in elevation.
FIGS. 2*a*, 2*b* and 2*c* are transverse cross sectional views taken along lines 2*a*—2*a*, 2*b*—2*b* and 2*c*—2*c* in FIG. 1.

FIG. 1 shows the sampling tool 1 comprising two chambers 12,14 mainly separated by a compressible pipe 9, shown as a triple-layer pipe. The sampling tool 1 includes an outer pipe 2 in the form of a cylindrically shaped container for retaining a reservoir pressure. Inside the outer pipe 2 there is a unit 13 forming the gas tight chamber 12 for receipt of a gas-/liquid sample. The dotted line 15 illustrates the shape of pipe 9 is it is compressed. The chamber 14 is limited by the inside of the outer pipe 2 and by the outside of the compressed pipe 9. The inner unit 13 consists of opposite end supports or wedges 5 and 6, a U-profile support member 10, i.e. a member having a U-shaped transverse cross-sectional configuration and the pipe 9, preferably made of lead. The pipe 9 can be made of other suitable materials. The essential thing is that the material of, pipe 9 be flexible and diffusion tight. For a less flexible metal than lead, it is important for compression that the pipe has a weakened field from where compression can start. If flexible material such as rubber is used there will be no need for a weakened field. Generally, it is the type of samples that determine what material to choose for the compressible pipe. The supporting wedges 5 and 6 are mounted and secured to opposite ends of the U-profile. The U-profile and the wedges 5 and 6 form one unit which is positioned inside the lead pipe 9. The lead pipe 9 is fastened to the wedges 5 and 6, for instance by glue or solering, and thus there is formed a gas tight unit defining chamber 12 for receipt of the gas-/liquid sample.

The wedge 6 has a central longitudinal bore 8 ending inside the lead pipe 9. Bore 8 is for supply of the gas-/liquid sample to the storage or conservation chamber 12. The chamber 14 is filled with a counter pressure medium before the gas-liquid sampling operation starts. This enables a controlled and gradual filling of chamber 12. Each of the wedges 5 and 6 is circular at one end thereof and is slanted at the other end thereof. During filling of chamber 14 the slanted ends of the supporting wedges provide a smooth transition from circular shape of the lead pipe to the compressed state thereof.

FIGS. 2*a*-2*c* are cross sectional views of the sampling tool. In FIG. 2*a*, section A—A the lead pipe 9 and the supporting wedge 5 are shown as circular. This part and the opposite end part of the lead pipe will remain unchanged during filling of both chambers 12 and 14. The outer cross section of the unit 13 is somewhat less than the inner cross section of the outer pipe 2. The gap between the inside of pipe 2 and the outside of pipe 9 will always be filled by some counter pressure medium and thus will reduce the wear of the lead pipe. The gap also simplifies the insertion of the unit 13 and allows flow of the counter pressure medium during filling of chamber 14. The cross sectional view of FIG. 2*b* shows the shape of the lead pipe when the chamber 12 for the gas-/liquid sample is filled. The lead pipe 9 will have the original pipe shape in this position. The gas-/liquid sample in chamber 12 has, during filling, reduced the volume of chamber 14 significantly and pressed the counter pressure medium into a separate atmospheric chamber (not shown). The cross sectional view of FIG. 26 shows a sampling unit where the lead pipe is pressed against the inside of the U-profile 10, as shown by the dotted line 15 in FIG. 1. This is the shape of the lead pipe when the sampling tool is ready to for use and chamber 14 is filled with a counter pressure fluid such as glycol. The counter pressure fluid flows during filling on the outside of the lead pipe 9 and presses the lead pipe 9 against the inner wall of the U-profile and thus reduces the volume of the storage chamber 12 approximately to zero. FIGS. 2*b* and 2*c* also illustrate rounded edges of U-profile that come into contact with pipe 9.

When the collection of the gas-/oil sample starts, channels leading to the reservoir are opened simultaneously as a channel to the chamber at atmospheric pressure is opened. The gas-/liquid sample flows due to the reservoir pressure through bore 8 into the inside of the lead pipe, resulting in that the counter pressure medium on the outer side of the lead pipe is pressed into the atmospheric chamber. The gas-/liquid sample and the counter pressure medium are completely separated during sampling by the lead membrane or pipe 9. The counter pressure medium causes a smooth filling of the storage chamber 12 and thus prevents unnecessary strain on the lead pipe. The atmospheric chamber for the counter pressure medium has less volume than the storage chamber. Some of the counter pressure medium will therefore remain on the outside of the lead pipe and will prevent the lead pipe from under going metal to metal contact or from being punctured.

Figure 3:
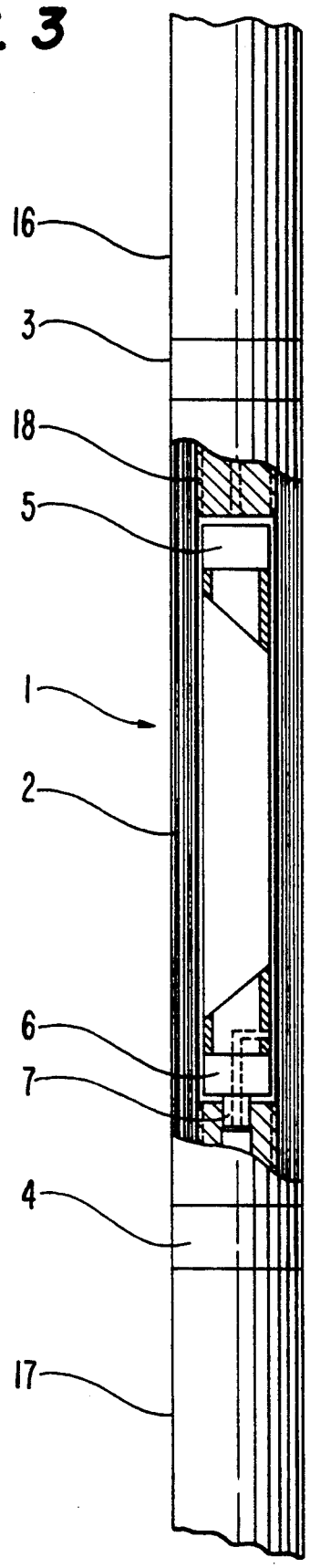
FIG. 3 is an elevation view illustrating sampling tools connected and where one sampler is illustrated in longitudinal section.

FIG. 3 shows a complete sampling system including valves 3, 4 for control of the sampling operation. The outer pipe 2 has threads 18 in opposites ends for connection to the valves 3, 4. The supporting wedges 5 and 6 are not identical. One of the supporting wedges, in this example wedge 6, has a male part 7 for connection with the female part of the valve 4. The valves can, in addition to regulating the opening/closing of the channels, also function as connection sections for other sampling tools 16, 17. The unit including the lead pipe, wedges and U-profile is finished in a workshop where it is pressure- and diffusion tested before it is mounted as one unit in the outer casing 2.

The sampler according to the invention provides a sampling tool where a gas-/liquid sample is separated from a counter pressure medium. There is no possibility for any leakage or diffusion from the storage chamber into the counter pressure chamber. The storage chamber according to the invention is simple to manufacture and use, and there are no parts exposed to wear. The sampler is therefore inexpensive to manufacture and is most reliable.

We claim:

1. A sampling tool to be immersed in a well for collection of samples during drilling for or production of oil, gas or water, said tool comprising a tubular hollow member and a unit positioned within said member for defining therein separated chambers including a first chamber to be filled selectively with a sample and a second chamber to receive a counter pressure medium, said unit comprising:

a support member having opposite longitudinally spaced ends and a U-shaped transverse cross-sectional configuration;

a pair of end supports connected to respective said opposite ends of said support member;

a collapsible tubular member surrounding said support member and said end supports and having opposite ends connected to respective said end supports; and said first chamber being defined internally of said collapsible tubular member, and said second chamber being defined externally of said unit;

whereby prior to a sample taking operation the counter pressure medium collapses said collapsible tubular member inwardly against said U-shaped cross section of said support member, and during a sample taking operation a sample is introduced into said first chamber and expands said collapsible tubular member away from said support member.

2. A tool as claimed in claim 1, wherein said end supports comprise wedge-shaped members.

3. A tool as claimed in claim 2, wherein each said wedge-shaped member includes an inclined surface extending into said support member, thus providing a gradual transition from the tubular shape of said collapsible tubular member to the collapsed shape thereof when collapsed against said support member.

4. A tool as claimed in claim 1, wherein said tubular hollow member is cylindrical, and said collapsible tubular member is cylindrical when not collapsed.

5. A tool as claimed in claim 1, wherein one said end support has therethrough a sample supply bore.

6. A tool as claimed in claim 5, wherein said bore opens between an outer surface of said one end support and an inner surface of said collapsible tubular member.

7. A tool as claimed in claim 1, wherein edges of said end supports and said support member that contact said collapsible tubular member are rounded.

8. A tool as claimed in claim 1, wherein said collapsible tubular member is formed of a deformable material.

9. A tool as claimed in claim 8, wherein said material comprises lead.

10. A unit to be positioned within a tubular hollow member to form a sampling tool to be immersed in a well to collect samples during drilling for or production of oil, gas or water, said unit comprising:

a support member having opposite longitudinally spaced ends and a U-shaped transverse cross-sectional configuration;

a pair of end supports connected to respective said opposite ends of said support member;

a collapsible tubular member surrounding said support member and said end supports and having opposite ends connected to respective said end supports; and a sample receiving chamber being defined internally of said collapsible tubular member.

11. A unit as claimed in claim 18, wherein said end supports comprise wedge-shaped members.

12. A unit as claimed in claim 11, wherein each said wedge-shaped member includes an inclined surface extending into said support member, thus providing a gradual transition from the tubular shape of said collapsible tubular member to the collapsed shape thereof when collapsed against said support member.

13. A unit as claimed in claim 10, wherein one said end support has therethrough a sample supply bore.

14. A unit as claimed in claim 13, wherein said bore opens between an outer surface of said one end support and an inner surface of said collapsible tubular member.

15. A unit as claimed in claim 10, wherein edges of said end supports and said support member that contact said collapsible tubular member are rounded.

16. A unit as claimed in claim 10, wherein said collapsible tubular member is formed of a deformable material.

17. A unit as claimed in claim 16, wherein said material comprises lead.

* * * * *